US009466907B2

(12) United States Patent
Sakaue et al.

(10) Patent No.: US 9,466,907 B2
(45) Date of Patent: Oct. 11, 2016

(54) CONNECTOR

(71) Applicant: IRISO ELECTRONICS CO., LTD., Kanagawa (JP)

(72) Inventors: Jyunya Sakaue, Kanagawa (JP); Yoshiyuki Ogura, Kanagawa (JP); Ken Chiba, Kanagawa (JP); Katsumasa Sato, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/715,703

(22) Filed: May 19, 2015

(65) Prior Publication Data

US 2015/0340788 A1 Nov. 26, 2015

(30) Foreign Application Priority Data

May 26, 2014 (JP) ..... 2014-108566

(51) Int. Cl.

| | |
|---|---|
| ***H01R 13/11*** | (2006.01) |
| ***H01R 24/60*** | (2011.01) |
| ***H01R 12/73*** | (2011.01) |
| ***H01R 13/24*** | (2006.01) |

(52) U.S. Cl.

CPC ..... *H01R 13/11* (2013.01); *H01R 12/73* (2013.01); *H01R 13/245* (2013.01); *H01R 13/2457* (2013.01); *H01R 24/60* (2013.01)

(58) Field of Classification Search

CPC .. H01R 24/60; H01R 13/6587; H01R 43/16; H01R 12/716; H01R 13/04; H01R 24/62; H01R 13/187

See application file for complete search history.

(56) References Cited

U.S. PATENT DOCUMENTS 3,579,176 A * 5/1971 Bokor ..... H01R 43/00 439/633
4,715,820 A 12/1987 Andrews, Jr. et al.

(Continued)

FOREIGN PATENT DOCUMENTS

EP 0036264 A2 9/1981
EP 1930987 A2 6/2008

(Continued)

OTHER PUBLICATIONS

Office Action for Japanese Patent App. No. 2014-108566 (Nov. 24, 2015).

(Continued)

*Primary Examiner* — Truc Nguyen
(74) *Attorney, Agent, or Firm* — Cermak Nakajima & McGowan LLP; Tomoko Nakajima

(57) ABSTRACT

A terminal used in a connector includes a base portion that is retained in a housing, and a front terminal and a rear terminal that extend from the base portion. A front terminal is provided with a front contact portion that comes in contact with a mating terminal through a flat plate surface of the front contact portion, and a rear terminal is provided with a rear contact portion that comes in contact with a terminal of a mating connector through a flat plate surface of the rear contact portion. The front contact portion and the rear contact portion are arranged at the same position in a width direction.

9 Claims, 11 Drawing Sheets

(56) References Cited

U.S. PATENT DOCUMENTS

| | | | | |
|---|---|---|---|---|
| 4,795,379 | A | 1/1989 | Sasaki et al. | |
| 5,009,606 | A | 4/1991 | Villeneuve et al. | |
| 5,324,215 | A * | 6/1994 | Walkup | H01R 43/16 439/857 |
| 5,582,519 | A * | 12/1996 | Buchter | H01R 23/688 439/101 |
| 6,315,621 | B1 | 11/2001 | Natori et al. | |
| 6,565,368 | B1 * | 5/2003 | Liao | H01R 13/112 439/342 |
| 2005/0020137 | A1 | 1/2005 | Tanaka et al. | |
| 2011/0067237 | A1 | 3/2011 | Cohen et al. | |

FOREIGN PATENT DOCUMENTS

| | | | |
|---|---|---|---|
| JP | 48-030755 | U | 4/1973 |
| JP | 58-007477 | U | 1/1983 |
| JP | 8-236187 | A | 9/1996 |
| JP | 2002-175847 | A | 6/2002 |
| JP | 2009-199766 | A | 9/2009 |
| JP | 2012-069243 | A | 4/2012 |

OTHER PUBLICATIONS

European Search Report for European Patent App. No. 15168022.0 (Oct. 5, 2015).

* cited by examiner

CONNECTOR

BACKGROUND OF THE INVENTION

1. Field of the Invention

The present disclosure relates to a terminal and a connector that are fitted into a connection object member such as a printed board and that are used to electrically connect two connection object members to each other.

2. Description of the Related Art

A connector for electrically connecting printed boards to each other includes a plurality of terminals. In a connector provided with a first housing that is disposed on one of the connection object member and a mating connector provided with a second housing that is disposed on the other connection object member, the first housing and the second housing are formed so as to be capable of being fitted to each other, and when fitting the first housing and the second housing together, the corresponding terminals come in contact with each other such that both of the connection object members are electrically connected to each other.

In such connectors, a connector is known in which two contact portions are formed in a single terminal in order to make the terminal of one connector and the terminal of the other connector in contact with each other in a reliable manner (Japanese Unexamined Patent Application Publication No. 2012-69243).

SUMMARY OF THE INVENTION

However, the terminals used in the above connector are terminals that are each formed by press punching a flat plate of a terminal material, and the fractured surfaces created by the pressing are used as contacts; accordingly, the surface roughness of the fractured surfaces are coarse and the frictional resistance between the terminals when one of the connectors are mounted to or dismounted from (when inserted into or released from) the other connector tends to be large. Accordingly, the operation feel when inserting and releasing the connector may disadvantageously be bad. Furthermore, since the bending direction of the contact is the plate surface direction of the terminal, when coming in contact with the mating terminal, the contact pressure tends to become high, and in order to keep the contact pressure within a desired numerical range, the degree of freedom of designing the shape of the terminal is, disadvantageously, relatively small.

The present disclosure has been made to overcome the above problems and an object thereof is to obtain a terminal that is capable of facilitating reduction in frictional resistance between the contact surfaces of the terminals and that allows easy adjustment to the desired contact pressure between the terminals to be performed, and a connector that is provided with the terminal.

In order to achieve the above object, the connector includes a housing; and a plurality of terminals that are retained in the housing and that are spaced apart from each other in a width direction, the connector being electrically connected by being in contact with mating terminals of a mating connector. The terminals are punched terminals that have been formed by press punching a flat plate, the terminals include a base portion retained in the housing, and a front terminal and a rear terminal that extend in parallel from the base portion, the front terminal includes a front contact portion that comes into contact with a mating terminal through a flat plate surface of the front terminal, and a front spring portion that extends from the base portion to the front contact portion, the rear terminal includes a rear contact portion that comes into contact with a mating terminal through a flat plate surface of the rear terminal and a rear spring portion that extends from the base portion to the rear contact portion, and the front contact portion and the rear contact portion are arranged at a same position in the width direction.

Since the terminals that are retained in the housing are punched terminals that have been formed by press punching a flat plate, the original can be formed easily by pressing a flat plate shaped metal. Furthermore, since the terminals each include a base portion that is retained in the housing, the terminals can be fixed to the housing.

Furthermore, since the front terminal and the rear terminal that extend from the base portion in a parallel manner includes the front contact portion and the rear contact portion, respectively, that come in contact with the mating terminal through the flat plate surfaces, there are two contact portions in contact with the mating terminal; accordingly, the contact reliability with the mating terminal can be increased. Moreover, since contact with the mating terminal is made through the flat plate surface, compared with a case in which contact is made through the press surface that is a fractured surface, contact with the mating terminal can be made through a surface with a smooth surface roughness; accordingly, frictional resistance when inserting and releasing the connector into and from the mating connector can be kept low. Furthermore, the operation feel when inserting and releasing into and from the mating connector can be made satisfactory.

Note that a "flat plate surface" is either of the two surfaces of the terminal except for the lateral surfaces (the edges) that is the thickness of the terminal. The "flat plate surface" may be in the form of either a curved roll surface or a flat surface with no curves.

Furthermore, since contact with the mating terminal is made through a flat plate surface, compared to a case in which contact with the mating terminal is made through the fractured press surface, the contact surface can be larger. Accordingly, even if there is a positional displacement when the connectors are fitted together, contact between the terminals can be performed in a reliable manner.

Furthermore, since contact with the mating terminal is made through the flat plate surface, the bending direction of the contact portion is the plate thickness direction of the terminal; accordingly, compared with a case in which the bending direction is the direction orthogonal to the plate thickness of the terminal, pressure that bends the contact portion can be reduced. Accordingly, adjustment of the contact pressure can be performed easily.

The front terminal and the rear terminal include, respectively, a front spring portion that extends from the base portion to the front contact portion, and a rear spring portion that extends from the base portion to the rear contact portion; accordingly, a terminal with spring portions can be formed easily by bending the original punched terminal in the plate thickness direction. Furthermore, since the front terminal and the rear terminal extend from the base portion separately, the front terminal and the rear terminal can be separately bent with respect to each other. Accordingly, the contact pressures of the front terminal and the rear terminal in contact with the mating terminal can be adjusted separately.

Since the front contact portion and the rear contact portion are arranged at the same position in the width direction, when fitted to the mating connector, the front contact portion and the rear contact portion sequentially come into contact with the mating terminal along a straight line extending in the insertion and releasing direction of the connector. Furthermore, the front terminal may perform wiping of foreign substances adhered to the mating terminal and the rear terminal following the front terminal may come into contact with the mating terminal. Accordingly, even if foreign substances such as dirt and dust are present in the contact portion between the front contact portion and the mating terminal, in the course of inserting the front contact portion, the foreign substances can be removed or retained; accordingly, the rear contact portion can be made to come in contact with the mating terminal at a portion where the front contact portion has passed and where there is no foreign substance. Accordingly, conductive connection with the mating terminal can be performed in a reliable manner.

The front spring portion of the front terminal may include a plurality of bent portions that are sequentially bent from the base portion to the front contact portion in directions that approach the mating terminal. More specifically, the front spring portion is configured so as to include a first bent portion that bends in a direction that approaches the mating terminal, a first inclined spring piece portion that extends from the first bent portion, a second bent portion that bends in a direction that further approaches the mating terminal from the distal end of the first inclined spring piece portion, and a second inclined spring piece portion that extends from the second bent portion.

The connector is assumed that the front spring portion includes a single bent portion that bends in a direction that approaches the mating terminal in a greater manner with respect to the base portion, and that the terminal piece from the bent portion to the front contact portion has a straight shape or a curved shape. In the connector, when the front terminal comes in contact with the mating terminal and receives a pressing force, the distal end side of the front contact portion is displaced as if falling down while pivoting with a large pivoting radius about the single bent portion serving as a pivotal center (fulcrum of displacement). With the above, there are cases in which the contact reliability of the front contact portion is degraded since the contact position of the front contact portion is also moved and displaced towards the front spring portion side from the regular contact position. In order to prevent the above, the contact area between the mating terminal, which is the contact of the front terminal, may be set long so that, while obtaining a predetermined spring length in the front spring portion, a desired contact reliability is obtained even if the contact position were to move and be displaced; however, the above will increase the overall length of the terminal and the size of the connector, accordingly, it is difficult to give a margin to the length of the contact area of the front contact portion.

Conversely, in the front spring portion of the present disclosure including a plurality of bent portions, since there is a plurality of bent portions that are bent in directions that approaches the mating terminal, the front spring portion can obtain a predetermined long spring length; accordingly, the contact area of the front contact portion can be extended to the front spring portion side. As described above, since there is a margin in the contact area, even if the contact position were to move, the desired contact reliability can be obtained.

As described above, the terminal of the present disclosure is a punched terminal formed by press punching a flat plate. Furthermore, since the front contact portion and the rear contact portion are arranged at the same position in the width direction, in a state in which the flat plate has been press punched, the rear contact portion and the front contact portion need to be arranged so as not to interfere with each other. In such a case, in order to have the front contact portion come in contact with the mating terminal before the rear contact portion, the rear contact portion needs to be disposed on the base portion side with respect to the front contact portion; accordingly, the spring length of the rear spring portion is, consequently, limited to the length between the base portion and the front contact portion when in a state in which the flat plate has been press punched.

Conversely, as in the present disclosure, by configuring the front spring portion of the front terminal to be a multistage spring, the spring length of the front spring portion can be increased when in a state in which the flat plate has been press punched, without increasing the overall length of the terminal. Accordingly, since the distance from the base portion to the front contacts portion is increased as well, the spring length of the rear spring portion can be made accordingly longer in a similar manner. Accordingly, not only the length of the front spring portion, the length of the rear spring portion can be made longer such that elastic deformation can be performed in a flexible manner.

The front spring portion of the front terminal and the rear spring portion of the rear terminal may extend from a boundary portion of a restriction portion, in which the restriction portion is a portion in the base portion restricted by the housing. With the above, the front spring portion and the rear spring portion protrude out from the restriction portion restricted by the housing in the base portion and, accordingly, the springs can be springs with a greater flexibility.

At least either one of the front spring portion and the rear spring portion may be a tapered spring in which a distal end side is narrower than a proximal end side. By configuring the front spring portion and the rear spring portion to have a tapered spring shape, elastic deformation in a flexible manner can be performed throughout the whole length. In particular, the distal end side can obtain spring elasticity such that buckling, break, and the like can be prevented from occurring.

Note that, herein, a "tapered spring" denotes a tapered shaped spring in which, in the case of the front spring portion, the plate width becomes narrower from the base portion side towards the front contact portion and, in the case of the rear spring portion, denotes a tapered shaped spring in which the plate width becomes narrower from the base portion side towards the rear contact portion. In any case, it is only sufficient that the spring has a shape in which the width of the distal end is narrower than that of the base end, and there may be a portion in which the plate width in the intermediate portion between the base and the distal end is uniform or a portion in which the plate width becomes slightly larger.

A contact pressure of the front terminal may be set smaller than a contact pressure of the rear terminal. Since the contact pressure of the front terminal is small, work efficiency during transition from the guiding state in which the connectors start to be fitted to each other to the state in which only the front terminal is inserted and is in contact with the mating terminal is improved. Furthermore, in the above state, the positions between the two connectors are determined, and transition to a state in which the rear terminal that has a larger contact pressure than the contact pressure of the front terminal is inserted and is in contact with the mating terminal can be made easily. In other words, ease of operation during fitting can be improved.

The front contact portion may protrude more towards the mating terminal with respect to the rear contact portion.

Since the front contact portion protrudes more towards the mating terminal side with respect to the rear contact portion, contact with the mating terminal can be facilitated and foreign substances wiping performance can be improved.

The width of the front contact portion and the width of the rear contact portion can be set substantially the same. By setting the widths to be substantially the same, the rear contact portion can sufficiently pass through the portion where the front contact portion has passed and has performed wiping. Furthermore, space for the terminal in the width direction can be minimized.

Furthermore, positional displacement between the position where the front contact portion comes into contact with the mating terminal and the position where the rear contact portion comes into contact with the mating terminal can be prevented from occurring easily.

Alternatively, the width of the front contact portion can be larger than the width of the rear contact portion. By having a wide front contact portion, wiping can be performed in a wide area. Accordingly, even if the front terminal and the rear terminal are relatively displaced with respect to each other, the front contact portion can perform wiping in a wide range and removal of foreign substances from the portion where the rear contact portion comes into contact can be improved.

The front spring portion of the front terminal may extend from two portions of the base portion and is linked at a portion before the front contact portion so that a space in which the rear terminal is disposed so as to be interposed in the middle is formed.

Since the front spring portion of the front terminal is formed so as to extend from two portions of the base portion and the two extended portions are linked with each other at a portion before the front contact portion so that a space in which the rear terminal is disposed so as to be interposed in the middle is formed, two arm portions, namely the front terminal and the rear terminal, are provided and the front contact portion and the rear contact portion can be arranged at the same position in the width direction such that the terminal shape is formed symmetrically. Accordingly, the terminal can be displaced equally on both sides against force acting in the width direction, and pairs of terminals, the terminals in each pair having the same shape and opposing each other, may be equally displaced.

Furthermore, since a front spring portion that extends from two portions of the base portion is provided, the width of the front terminal can be formed in a relatively wide manner. Accordingly, even if the front terminal is formed longer than the rear terminal, the contact pressure of the contact portion can easily be made to approach the contact pressure of the contact portion of the rear terminal such that the contact pressure of the front terminal can be prevented from becoming excessively low. In other words, if each of the contact pressures of the front terminal and the rear terminal based on the basic shapes of the front terminal and the rear terminal are substantially the same, the contact pressure of the front terminal and the rear terminal can be easily changed and the contact pressure difference thereof may be easily adjusted by adjusting the width and length of the arms. Furthermore, since the rear terminal is interposed between the front spring portion, even if the rear terminal is about to be displaced greatly in the width direction, the rear terminal is restrained by the front spring portion and will not be displaced excessively. Accordingly, contact between the rear terminal and the mating terminal can be performed in a reliable manner.

Furthermore, a connector that achieves connector coupling and that includes a floating structure that movably supports a movable housing with respect to a fixed housing when the terminal is fitted to the mating connector is provided.

In order to achieve connector coupling that is provided with the floating structure that movably supports the movable housing with respect to the fixed housing when the connector is fitted to the mating connector, even if there is positional displacement between one connector and the other connector and even if fitted obliquely, the fitting of both connectors can be performed reliably. Furthermore, the permissible range of displacement in the width direction and the permissible range of displacement in angle while fitting the two connectors together can be increased.

According to the connector of the present disclosure, contact with the mating terminal can be reliably made with the front terminal and the rear terminal. Since contact with the mating terminal is made through a flat plate surface of the terminal, frictional resistance between the mating terminal when inserting and releasing the connector is low and operation feel during insertion and release of the connector can be improved. Furthermore, degree of freedom of design of the terminal shape can be relatively high.

Furthermore, according to the connector of the present disclosure, even if an irregular fitting, including positional displacement of the connector with respect to the mating connector and occurrence of an oblique connection, is performed, the contact reliability between the terminals is high.

BRIEF DESCRIPTION OF THE DRAWINGS

FIG. 9B is a front view of the terminal.

FIGS. 16A to 16E are explanatory drawings of a terminal of a third exemplary embodiment, in which FIG. 16A is a right side view, FIG. 16B is a front view, FIG. 16C is a rear view, FIG. 16D is a plan view, and FIG. 16E is a bottom view.

FIGS. 17A and 17*b* are diagrams for describing an operation of a front terminal, in which FIG. 17A is an explanatory drawing of a front terminal of a third exemplary embodiment in a displaced state, and FIG. 17B is an explanatory drawing of the front terminal of the first exemplary embodiment in a displaced state.

DESCRIPTION OF THE PREFERRED EMBODIMENTS

Figure 1:
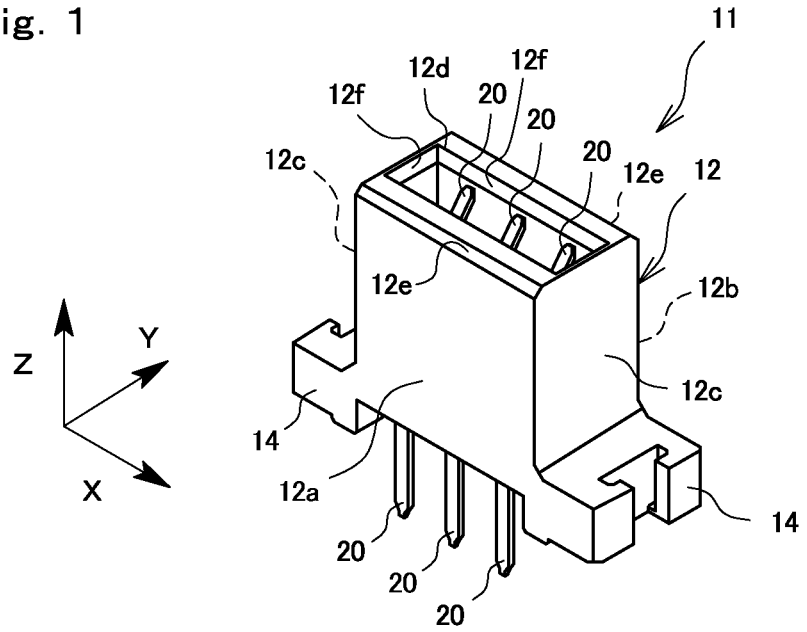
FIG. 1 is a perspective view of a connector of a first exemplary embodiment.

Referring to the drawings, embodiments of the present disclosure will be described in further detail. Components common in each of the following embodiments will be designated with the same reference numerals and repeated description will be omitted. Furthermore, repeated description of materials, manufacturing method, effects, and the like that are common in the following embodiments will be omitted as well.

First Exemplary Embodiment (FIGS. 1, and 3 to 9)

Figure 2:
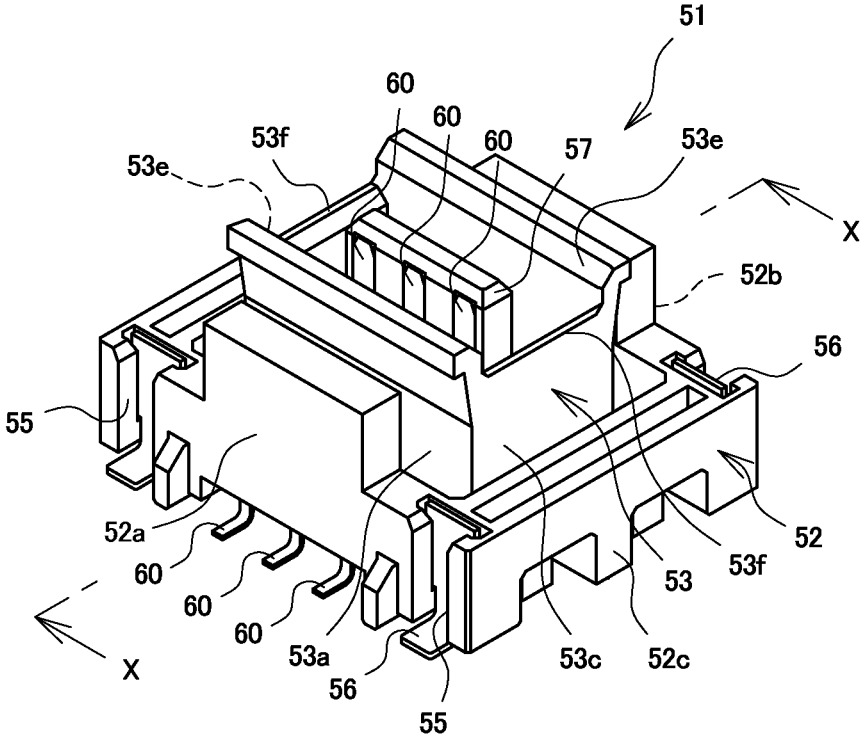
FIG. 2 is a perspective view of a mating connector that is fitted with the connector of FIG. 1.
Figure 3:
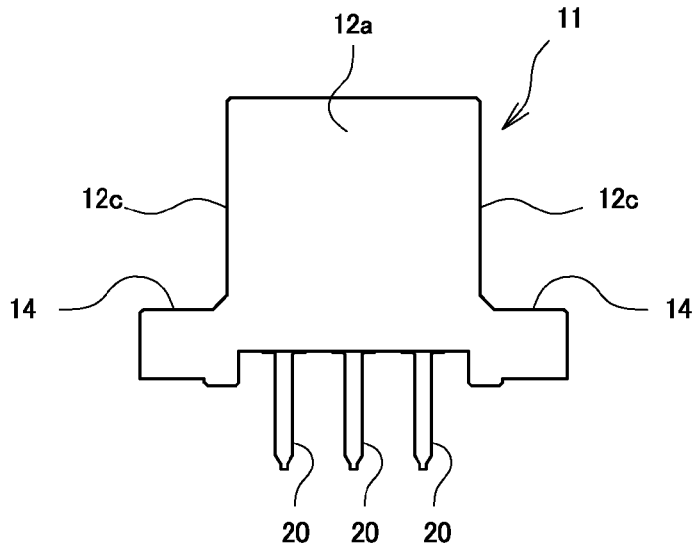
FIG. 3 is a front view of the connector of FIG. 1.
Figure 4:
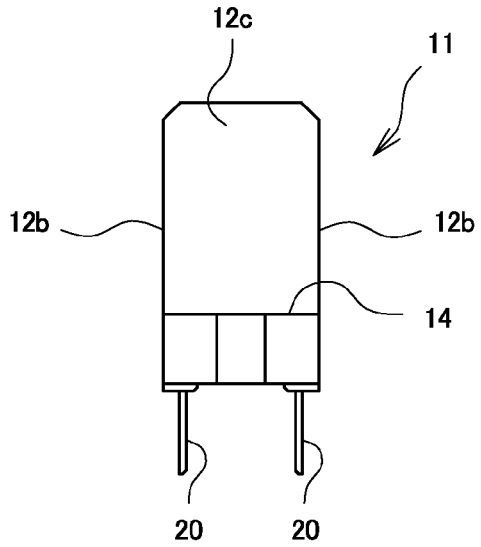
FIG. 4 is a right side view of the connector of FIG. 1.
Figure 5:
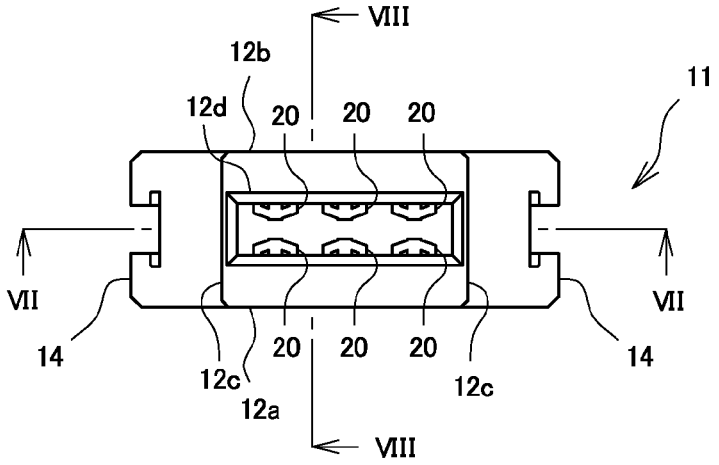
FIG. 5 is a plan view of the connector of FIG. 1.
Figure 6:
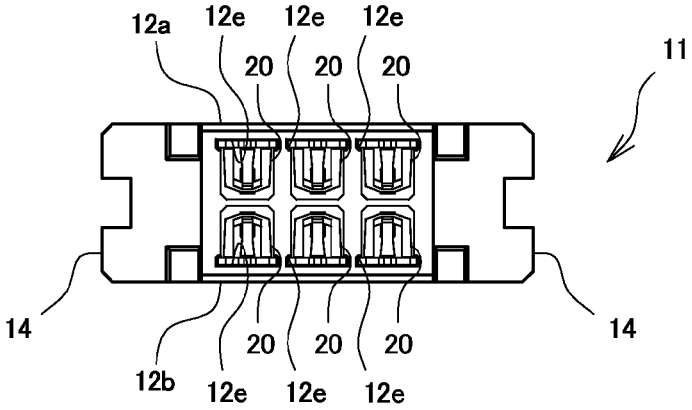
FIG. 6 is a bottom view of the connector of FIG. 1.
Figure 7:
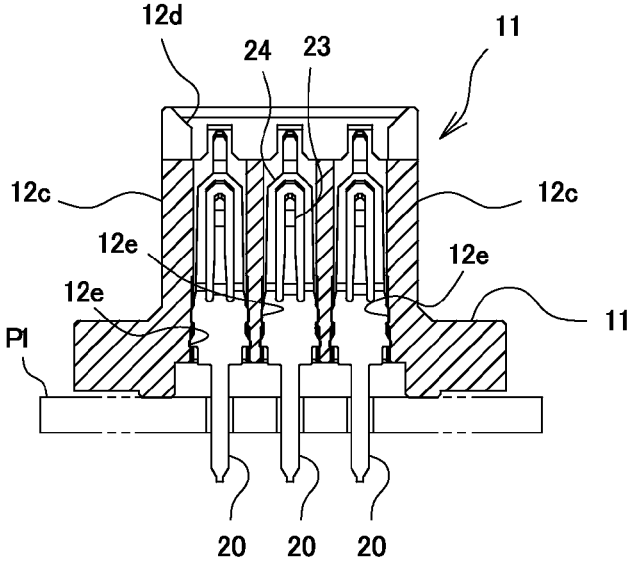
FIG. 7 is a cross-sectional view taken along line VII-VII in FIG. 5.
Figure 8:
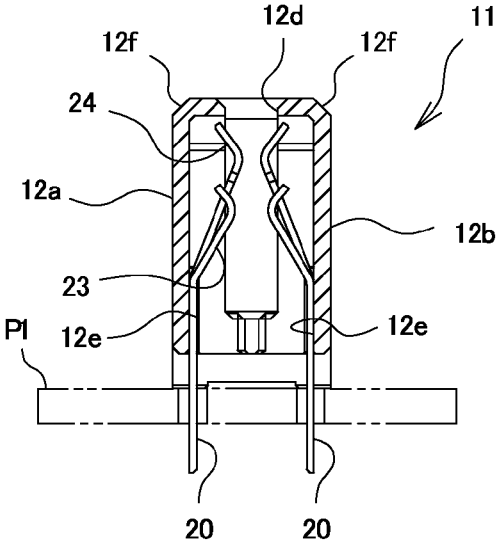
FIG. 8 is a cross-sectional view taken along line VIII-VIII in FIG. 5.
Figure 9A:
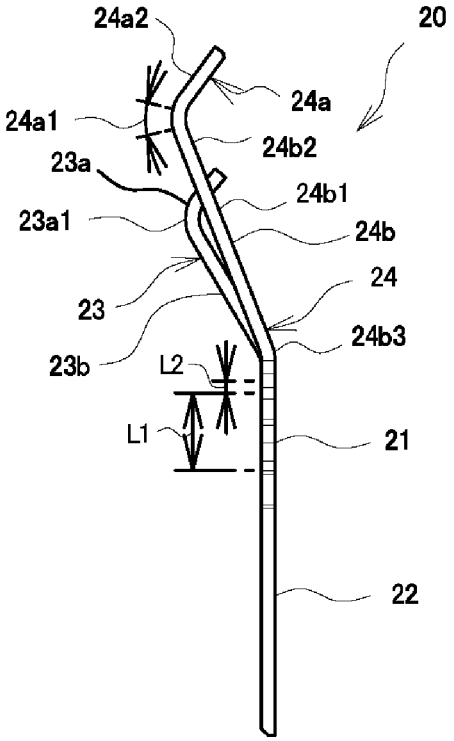
FIG. 9A is a right side view of the terminal.
Figure 9C:
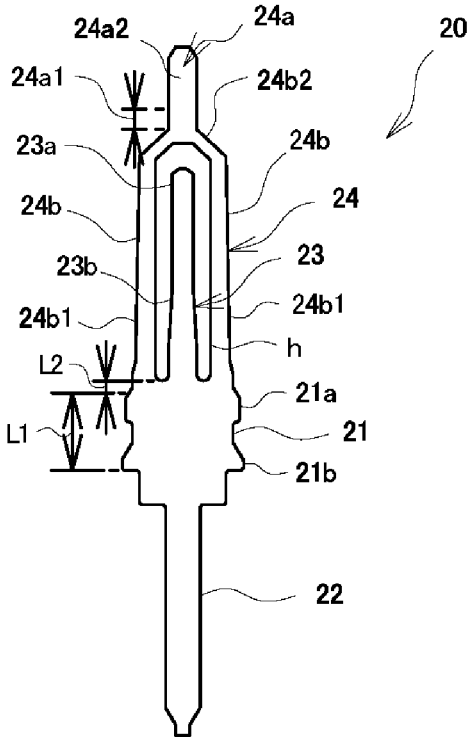
FIG. 9C is an enlarged front view of a portion around a contact portion of the terminal.
Figure 9C:
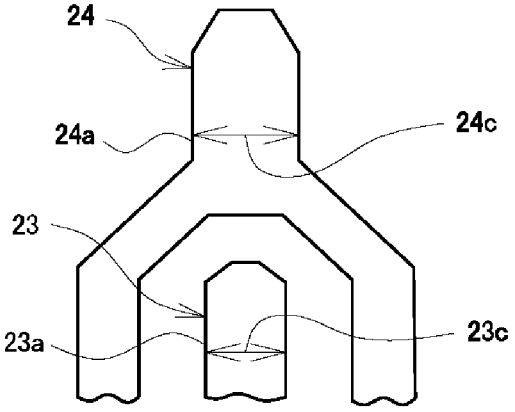

A connector 11 is illustrated in FIGS. 1 and 3 to 8. FIG. 1 is a perspective view, FIG. 3 is a front view, FIG. 4 is a right side view, FIG. 5 is a plan view, and FIG. 6 is a bottom view. Furthermore, FIGS. 7 and 8 are cross-sectional views of the connector 11. The connector 11 includes a housing 12 and terminals 20 that are illustrated in FIGS. 9A to 9C. The connector 11 is disposed on a connection object member (not shown) such as a printed board, and is fitted to a mating connector 51, such as the one illustrated in FIG. 2, that is disposed on another printed board such that the printed boards are electrically connected to each other.

In the present description and the claims, as a matter of convenience, in order to distinguish the connectors 11 and 51, the connector 11 is referred to as a socket connector and the connector 51 is referred to as a plug connector or a mating connector. The terminals 20, in the sense that the terminals 20 are terminals that are attached to the connector 11, are referred to as socket terminals and the terminals that are attached to the plug connector are referred to as plug terminals or mating terminals. Furthermore, the description will be given such that, in the socket connector 11 illustrated in FIG. 1, the X-axis direction is the width direction, the Y-axis direction is the front-rear direction, and the Z-axis direction is the up-down direction. Note that the description related to the directions does not determine the use direction of the connectors 11 and 51.

The housing 12 is a piece of molded synthetic resin and, as illustrated in FIG. 1, has a hollow box shape that has openings on an upper surface and a lower surface. In other words, the housing 12 includes a front surface portion 12*a*, a back surface portion 12*b*, and lateral surface portions 12*c* and 12*c*. Attaching portions 14 for attaching the housing 12 to the connection object member such as a printed board are provided at the lower portion of the lateral surface portions 12*c* and 12*c*. A receiving opening 12*d* that receives a fitting projection 57 of the plug connector 51 illustrated in FIG. 2 is open in the upper surface of the housing 12. By inserting the plug connector 51 into the receiving opening 12*d*, the connectors 11 and 51 can be fitted to each other.

Groove-shaped retaining portions 12*e* to which left and right plate edge portions 21*a* of the base portions 21 of the terminals 20 are press fitted and that are retained are provided on the inner wall side of the front surface portion 12*a* and the inner wall side of the back surface portion 12*b* of the housing 12 so as to oppose each other. With the above, the front surface, the back surface, and either of the left lateral surface and the right lateral surface of the plate edge portions 21*a* are retained by the retaining portions 12*e*.

A total of six terminals 20 are fixed to the housing 12 such that three terminals 20 on the inner wall side of the front surface portion 12*a* of the housing 12 and three terminals 20 on the inner wall side of the back surface portion 12*b* of the housing 12 face each other in pairs.

Each of the terminals 20 is a punched terminal that is formed by press punching a flat plate and, as illustrated in FIGS. 9A and 9B, includes a base portion 21 that is retained by the retaining portion 12*e* of the housing 12, a rear terminal 23 that extends from the middle portion of the base portion 21, a front terminal 24 that extends from both ends of the base portion 21 and that merges at the end side, and a connection portion 22 that extends to the side opposite the two arms 23 and 24 from the base portion 21 and that is connected to a conductor on the printed board side.

By having the left and right plate edge portions 21*a* of the base portions 21 be press fitted to the retaining portions 12*e* described above provided in the housing 12, the terminals 20 are retained and fixed to the housing 12. Accordingly, two press-fit projections 21*b* are formed in each pair of plate edge portions 21*a*. Each base portion 21 is fixed to the responding retaining portion 12*e* of the housing 12 in the area of a restriction portion L1 in FIG. 9B. Each of the base ends of the rear terminal 23 and the front terminal 24 are united into one at the upper side of the restriction portion L1 and are configured as a non-restriction portion L2 that does not come into direct contact with and that is not fixed to the walls forming the retaining portions 12*e* of the housing 12.

The rear terminal 23 includes a rear contact portion 23*a* that comes into contact with the terminal (plug terminal) 60 provided in the plug connector 51, and a rear spring portion 23*b* that is the portion between the base portion 21 and the rear contact portion 23*a* bent in the plate thickness direction of the terminal 20, in other words, towards the inner side of the housing 12. In the rear contact portion 23*a*, a rear contact 23*a*1 that comes into contact with the mating terminal is formed so as to be bent in a ridge shape. The rear terminal 23 is formed as a tapered spring in which the plate width becomes narrower from the proximal end side towards the distal end and is flexible throughout the whole length so as to be capable of being elastically deformed.

The front terminal 24 includes a front contact portion 24*a* that comes into contact with the terminal 60 provided in the plug connector 51, and front spring portions 24*b*.

The front contact portion 24*a* is formed in a strip shape and a front contact 24*a*1 that is bent in a ridge shape is formed on the front spring portions 24*b* side. The front contact 24*a*1 is located in an area indicated by the arrows in FIGS. 9A and 9B, and the above area is the area coming in contact with the mating terminal. A distal end portion 24*a*2 that inclines from the front contact 24*a*1 is formed. When the connector is fitted, each inclined surface comes into contact with the corresponding plug terminal 60 and guides the insertion.

The front spring portions 24*b* are regions ranging from the base portion 21 to the front contact portion 24*a*. The front spring portions 24*b* are bent in the plate thickness direction and merges at the middle at a portion before the front contact portion 24*a* such that a space h for disposing the rear terminal 23 is formed in the middle. The front spring portions 24*b* each include a long spring piece portion 24*b*1 that extends from the base portion 21 in parallel with the central axis of the front terminal 24, and a short spring piece portion 24*b*2 that extends obliquely from the distal end of the long spring piece portion 24*b*1 towards the center axis and that is connected to the base end of the front contact portion 24*a*. Each of the front spring portions 24*b* is a tapered spring in which the front spring portions 24*b* having a proximal end side of the long spring piece portion 24*b*1 with a large width becomes narrow in width towards the distal end of the short spring piece portion 24*b*2. With the above, by making the distal end side more flexible with respect to the proximal end side, the two front spring portions 24*b* are capable of being flexibly bent across the whole length; accordingly, a reliable contact force can be exerted even with narrow front spring portions 24*b*. A bent portion 24*b*3 that is bent in the direction coming in contact with the mating terminal 60 is formed on the proximal end side of the long spring piece portion 24*b*1.

The connection portion 22 is secured to a predetermined conductor of the printed board by soldering or the like.

When fitted to the mating connector 51, even if the front terminal 24 receives pressing force of the mating terminal 60 and is displaced to its maximum, since the rear terminal 23 of the terminal 20 is kept between the front spring portions 24*b* and 24*b* of the front terminal 24, the rear terminal 23 of the terminal 20 is not easily deformed in the X direction in FIG. 1. Furthermore, since the front spring portions 24*b* are united at the distal end side extending to the front contact portion 24*a* and, although hollow inside, the front terminal 24 is formed with a large width, the front terminal 24 is, similar to the rear terminal 23, not easily deformed even if an attempt is made to deform the front terminal 24 in the X direction in FIG. 1. Furthermore, since each terminal 20 and the corresponding terminal 60 are in contact with each other through the flat plate surfaces thereof, a wide contact is formed; accordingly, even if there is deformation in the X direction, contact failure does not occur easily.

Generally, a contact pressure between a terminal and a mating terminal decreases as the length of the spring portion of the terminal (the spring length) becomes longer and increases as the width of the spring portion becomes wider. In the terminal 20, since the length (the spring length) of the front spring portions 24*b* of the front terminal 24 is longer than the length (the spring length) of the rear spring portion 23*b* of the rear terminal 23, the front terminal 24 has a lower contact pressure; however, since the front spring portion 24*b* is arranged on both sides of the rear terminal 23 such that the rear terminal 23 is interposed between the front spring portions 24*b* and since the total width of the front spring portions 24*b* on both sides are longer than the width of the rear spring portion 23*b*, it is easier to make the contact pressure of the front terminal 24 approach that of the rear terminal 23. Accordingly, the contact pressure of the front terminal 24 can be easily adjusted so as not to be excessively low. Furthermore, since the overall width of the front terminal 24 including the space h is large, deformation in the width direction does not easily occur.

As described above, while the contact pressure of the front terminal 24 and the contact pressure of the rear terminal 23 can be appropriately adjusted, it is desirable that the contact pressure of the front terminal 24 is slightly lower than the contact pressure of the rear terminal 23. The above is desirable because ease of operation when the connectors 11 and 51 are fitted to each other is improved. Furthermore, the front contact 24*a*1 of the front contact portion 24*a* of the front terminal 24 is formed so as to protrude more towards the mating terminal 60 side with respect to the rear contact 23*a*1 of the rear contact portion 23*a* of the rear terminal 23; accordingly, a foreign substance removal effect of the front contact 24*a*1 is increased.

As illustrated in FIG. 9C, a width 24*c* of the front contact portion 24*a* and a width 23*c* of the rear contact portion 23*a* can be set in accordance with the purpose. As an example, the width 24*c* of the front contact portion 24*a* and the width 23*c* of the rear contact portion 23*a* can be set substantially the same. The widths are set so as to be substantially the same because if the widths are substantially the same, the rear contact portion 23*a* passes through the portion where the front contact portion 24*a* has passed when the socket connector 11 is fitted to the mating connector 51; accordingly, the rear contact portion 23*a* can be sufficiently passed through the portion where the front contact portion 24*a* has passed and has performed wiping. Furthermore, the widths are set so as to be substantially the same because positional displacement between the position where the front contact portion 24*a* comes into contact with the mating terminal 60 and the position where the rear contact portion 23*a* comes into contact with the mating terminal 60 does not easily occur.

Conversely, the width 24*c* of the front contact portion 24*a* can be set so as to be wider than the width 23*c* of the rear contact portion 23*a*. By setting the width of the front contact portion 24*a* large, wiping is performed in a wide range; accordingly, even if the positions of the front terminal 24 and the rear terminal 23 are relatively displaced, removal of foreign substances from where the rear contact portion 23*a* comes into contact can be increased.

As illustrated in FIG. 2, the mating connector 51 is configured by combining a fixed housing 52 and a movable housing 53. Each of the terminals 60 is disposed so as to extend across the fixed housing 52 and the movable housing 53.

The fixed housing 52 is a piece of molded synthetic resin and has a square tube-shape that has openings on the upper surface and the lower surface. In other words, the fixed housing 52 includes a front surface portion 52*a* and a back surface portion 52*b* that extends in the width direction and lateral surface portions 52*c* that extends in the front-rear direction.

Figure 10:
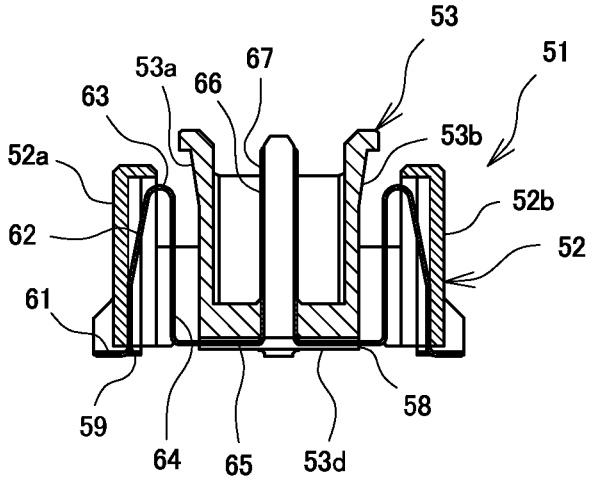
FIG. 10 is a cross-sectional view of the connector in FIG. 2 taken along line X-X.

A plurality of terminal holes 59 that each retain the corresponding terminal 60 are provided on the lower end sides of the front surface portion 52*a* and the back surface portion 52*b* at equal intervals (see FIG. 10).

Furthermore, attaching portions 55 for fitting the mating connector 51 to the printed board (not shown) and the like are provided at both ends of the front surface portion 52*a* and the back surface portion 52*b* and fixtures 56 are inserted into the attaching portions 55.

The movable housing 53 is a piece of molded synthetic resin and has a box-shape that has an opening on the upper surface. In other words, the movable housing 53 includes a front surface portion 53*a*, a back surface portion 53*b*, lateral surface portions 53*c*, and a bottom surface portion 53*d*. Furthermore, the movable housing 53 includes the fitting projection 57 that protrudes upwards from the center of the bottom surface portion 53*d*. Furthermore, a total of six terminals 60, three on the front surface and three on the back surface, are arranged and fixed on the two sides of the fitting projection 57. Furthermore, the terminals 60 are fixed while penetrating through the terminal holes 58 provided in the bottom surface portion 53*d* (see FIG. 10).

The terminal 60 has a substantially belt shape that is bent in the plate thickness direction and, as illustrated in FIG. 10, includes a connection portion 61 extending in the front-rear direction for connecting the terminal 60 to the printed board, a first terminal piece portion 62 that extends upwards from the rear end of the connection portion 61, a bent portion 63 that bends downwards from the upper end of the first terminal piece portion 62, a second terminal piece portion 64 that extends downwards from the bent portion 63, a third terminal piece portion 65 that extends from the lower end of the second terminal piece portion 64 along the bottom surface portion 53*d* of the movable housing 53, and a fourth terminal piece portion 67 that stands upwards from the third terminal piece portion 65 and that also serves as a contact portion 66 in contact with the terminal 20. Furthermore, the terminal 60 is capable of being elastically deformed in the width direction and the front-rear direction so as to allow the movable housing 53 to be moved with respect to the fixed housing 52.

Figure 11:
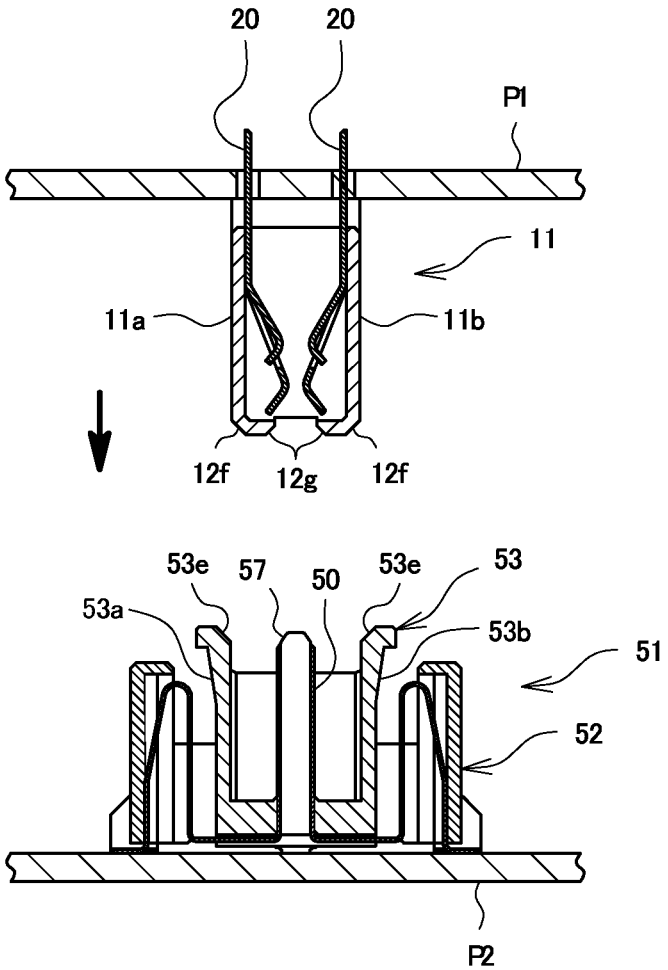
FIG. 11 is a cross-sectional view of the connector in FIG. 1 and the connector in FIG. 2 before being fitted to each other.

The socket connector 11 and the plug connector 51 configured in the above manner are capable of electrically connecting a pair of printed boards P1 and P2 to each other. As illustrated in FIG. 11, when linking, from above, the socket connector 11 that is connected to the printed board P1 to the plug connector 51 that is connected to the printed board P2, the socket connector 11 is moved downwards and the receiving opening 12*d* of the socket connector 11 is fitted to the fitting projection 57 of the plug connector 51.

Inclined surfaces 53*e* are formed on the front surface portion 53*a* and the back surface portion 53*b* of the movable housing 53 of the plug connector 51 and, further, outer chamfered surfaces 12*f* are formed in the outer lateral ends of a front surface portion 11*a* and a back surface portion 11*b* of the socket connector 11 and inner chamfered surfaces 12*g* are formed in the inner lateral ends thereof. Additionally, the movable housing 53 is capable of being displaced in the front-rear direction with respect to the fixed housing 52. Accordingly, the socket connector 11 can be easily fitted into the plug connector 51 even when the socket connector 11 is inclined in the front-rear direction of the socket connector 11 with respect to the plug connector 51. Accordingly, the socket connector 11 can be easily fitted into the plug connector 51 even when the position of socket connector 11 is displaced in the front-rear direction with respect to the plug connector 51.

Meanwhile, descending edges 53*f* are formed in the lateral surface portions 53*c* of the movable housing 53 at positions that are lower in height than the front surface portion 53*a* or than the back surface portion 53*b*. Furthermore, inner chamfered surfaces 12*g* are also formed on the lateral surface portions 12*c* of the socket connector 11. Additionally, each terminal 20 and the corresponding terminal 60 are in contact with each other through the flat plate surfaces. Accordingly, the socket connector 11 can be easily fitted into the plug connector 51 even when the socket connector 11 is inclined in the width direction of the socket connector 11 with respect to the plug connector 51. Accordingly, the socket connector 11 can be easily fitted into the plug connector 51 even when the position of socket connector 11 is displaced in the width direction with respect to the plug connector 51.

Figure 12:
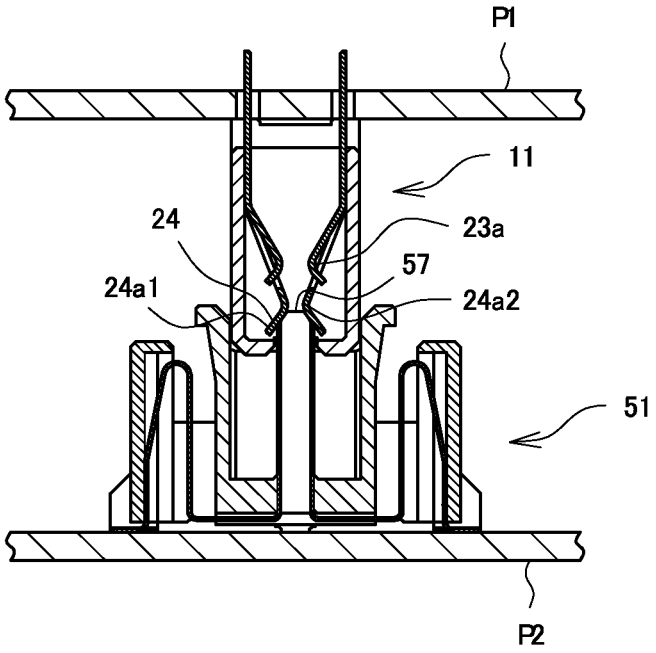
FIG. 12 is a cross-sectional view for describing the fitting process of the connector in FIG. 1 and the connector in FIG. 2, and illustrates a state in which a front contact portion and a fitting projection are in contact with each other.
Figure 13:
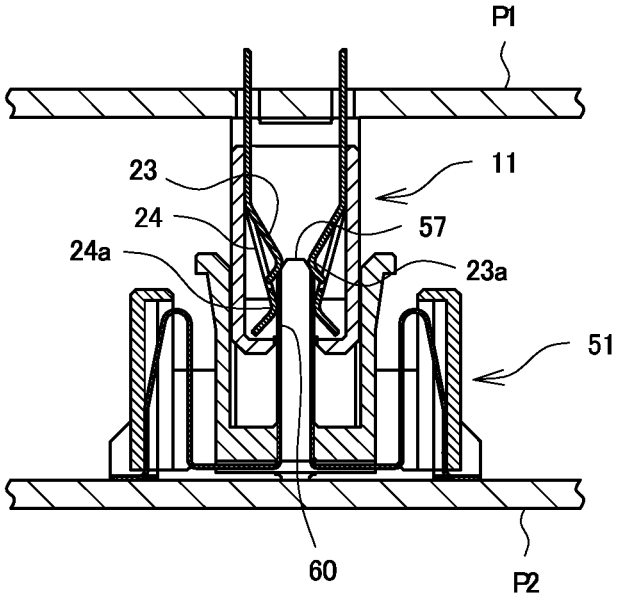
FIG. 13 is a cross-sectional view for describing the fitting process of the connector in FIG. 1 and the connector in FIG. 2, and illustrates a state in which the front contact portion and a rear contact portion are in contact with a fitting projection.

A process until the connectors 11 and 51 become completely fitted to each other will be sequentially described next. When the socket connector 11 is fitted to the plug connector 51, as illustrated in FIG. 12, a guiding state in which the distal end portions 24*a*2 of the front terminals 24 of the socket connector 11 abut against the fitting projection 57 of the plug connector 51 is reached first. When the socket connector 11 is further pushed in, only the front terminals 24 and are inserted. By setting the contact pressure of each front terminal 24 low, work efficiency when the guiding state is shifted to the state in which only the front terminals 24 are inserted is improved. As illustrated in FIG. 13, when fitting is subsequently proceeded until the rear terminals 23 abut against the fitting projections 57, the position of both connectors 11 and 51 are determined; accordingly, the rear terminals 23 can be easily inserted to a position in contact with the mating terminal 60 and contact pressures of the rear terminals 23 can be increased.

Figure 14:
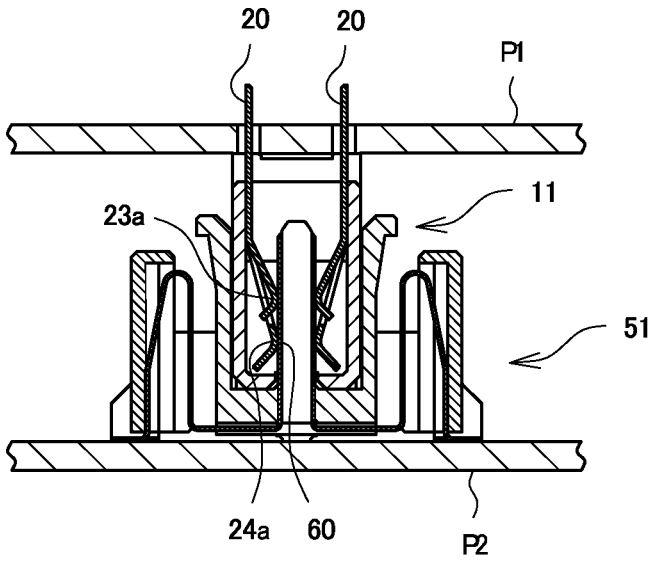
FIG. 14 is a cross-sectional view for describing a state in which the fitting between the connector in FIG. 1 and the connector in FIG. 2 has been completed.

From the above position, when the socket connector 11 is further pushed in, since the front contact portions 24*a* and the rear contact portions 23*a* are arranged at the same position in the width direction, each rear contact portion 23*a* comes into contact with the corresponding connections 60 while passing through the trace of the distal end portion 24*a*2 and the front contact 24*a*1 of the corresponding front contact portion 24*a* that has been in contact with the terminals 60. With the above, even if foreign substances such as dirt and dust adhere on the mating terminals 60, since the front contact portions 24*a* remove or retain the foreign substances, foreign substances are removed from the traces through which the front terminals 24 have moved. Accordingly, the rear contact portions 23*a* that pass through the trace in which foreign substances have been removed can be in conductive contact with the mating terminals 60 in a reliable manner. Finally, as illustrated in FIG. 14, a state is reached in which the front contact portions 24*a* and the rear contact portions 23*a* are both in contact with the terminals 60. As described above, in fitting the connectors 11 and 51 to each other, reliability of the conductive contact between the terminals 20 and 60 can be increased.

Second Exemplary Embodiment (FIG. 15)

Figure 15A:
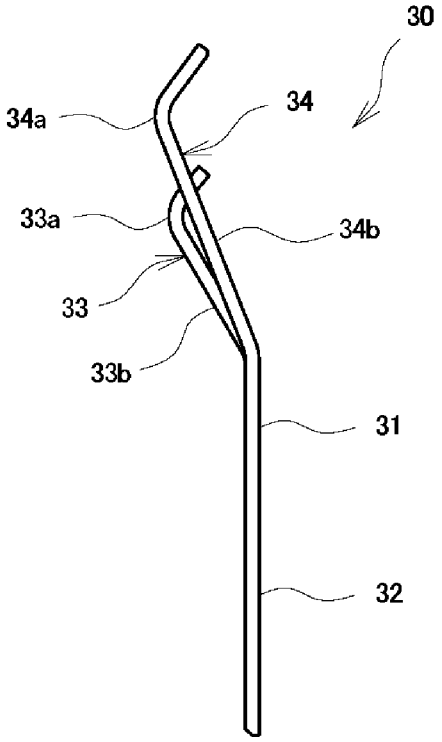
FIG. 15A is a right side view of a terminal of a second exemplary embodiment.
Figure 15B:
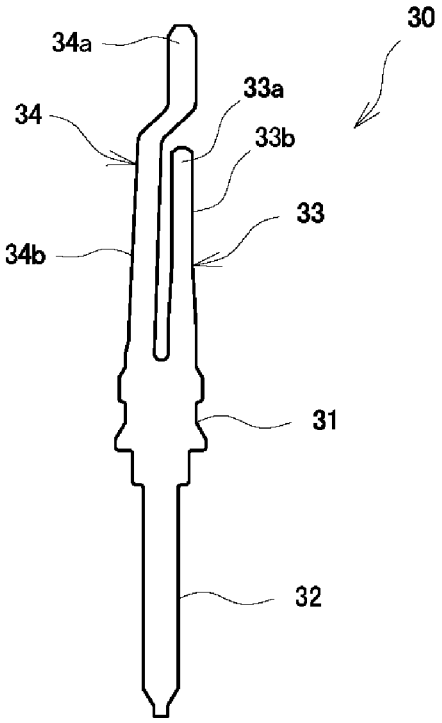
FIG. 15B is a front view of the terminal of the second exemplary embodiment.

Another terminal (a socket terminal) 30 employed in the socket connector 11 is illustrated in FIGS. 15A and 15B.

The terminal 30 also includes a base portion 31 that is retained by the retaining portion of the housing 12, a rear terminal 33 and a front terminal 34 that extend from the base portion 31, and a connection portion 32 that extends to the side opposite the two arms 33 and 34 from the base portion 31 and that is connected to a conductor on the printed board side.

Different from the terminal 20 illustrated in the exemplary embodiment described above, the terminal 30 includes a single front spring portion 34*b* in which no space h is formed in the front terminal 34. However, the terminal 30 is the same as the terminal 20 in that a front contact portion 34*a* of the front terminal 34 and a rear contact portion 33*a* of the rear terminal 33 are arranged in the same position with the same width.

Figure 15C:
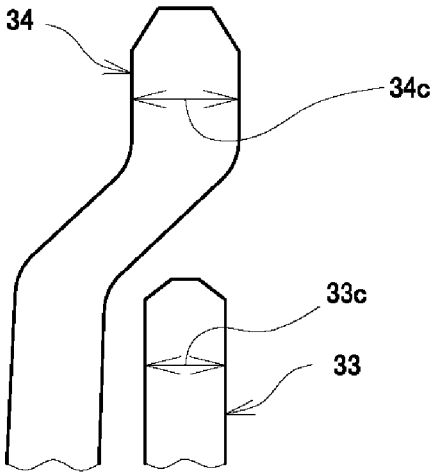
FIG. 15C is an enlarged front view of a portion around a contact portion of the terminal.

Furthermore, the terminal 30 is the same as the terminal 20 in that while the contact pressures of the front terminal 34 and the rear terminal 33 can be appropriately adjusted, the contact pressure of the front terminal 34 is desirably slightly lower than the contact pressure of the rear terminal 33, and in that the front contact portion 34*a* is desirably more protruded towards the mating terminal 60 side with respect to the rear contact portion 33*a*. Furthermore, as illustrated in FIG. 15C, the terminal 30 is the same as the terminal 20 in that a width 34*c* of the front contact portion 34*a* and a width 33*c* of the rear contact portion 33*a* are set in accordance with the purpose.

The above terminal 30 is also in contact with the mating terminal 60 through the flat plate surface; accordingly, the frictional resistance when inserting and releasing the connector can be low and a satisfactory operation feel can be obtained. Furthermore, since foreign substances can be removed with the front terminal, the contact reliability of the rear terminal with the mating terminal can be increased.

Figure 17A:
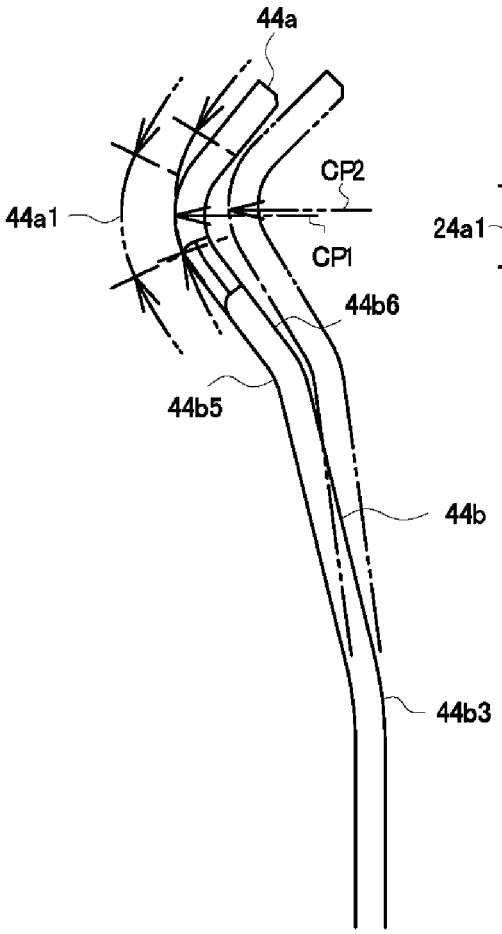
Figure 17B:
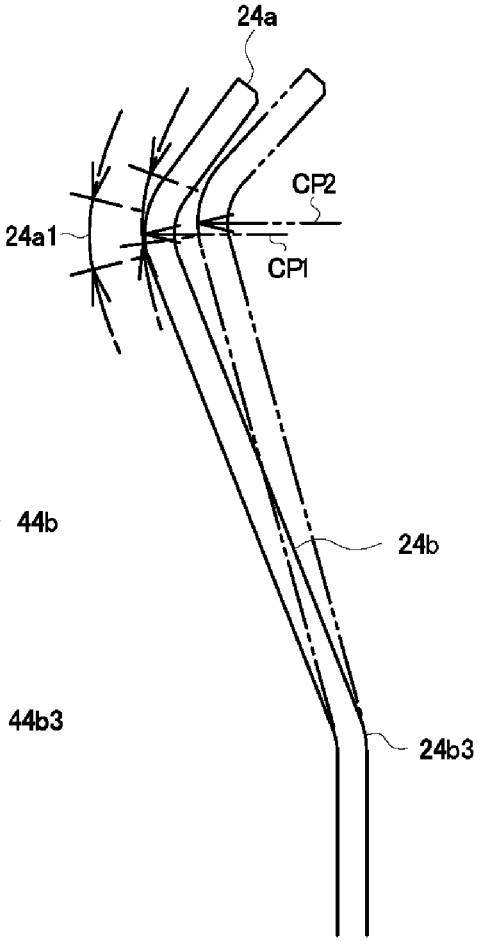
Figure 18:
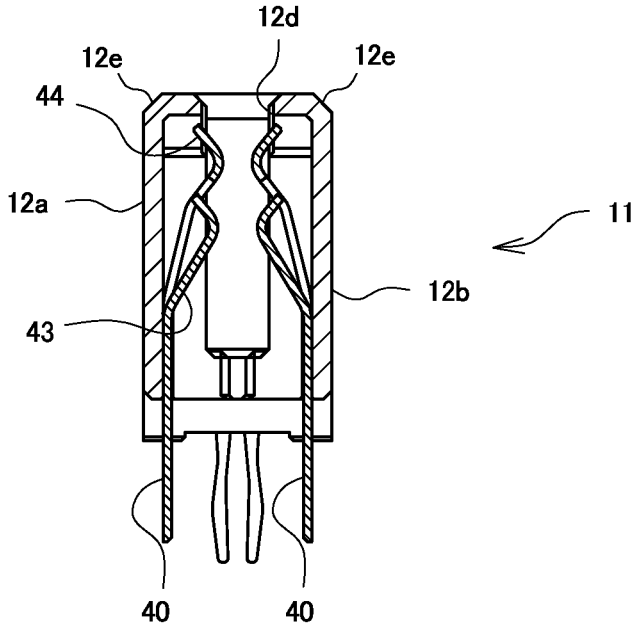
FIG. 18 is a cross-sectional view corresponding to the connector in FIG. 8 provided with the terminal in FIG. 16.
Figure 19:
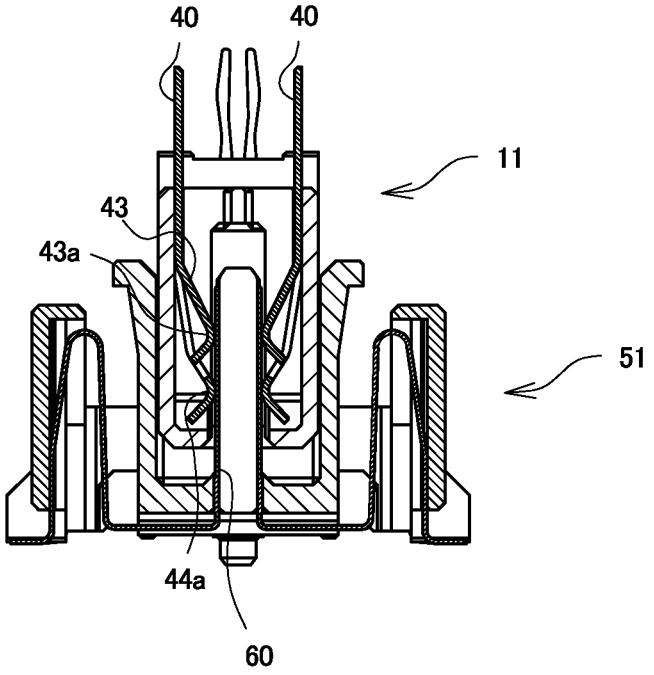
FIG. 19 is a cross-sectional view for describing a fitted state of a connector provided with a terminal in FIG. 16 and a connector in FIG. 2.

Third Exemplary Embodiment (FIGS. 16 to 18)

Still another exemplary embodiment of the connector 11 and a terminal (a socket terminal) 40 will be illustrated in FIGS. 16A to 18. The terminal 40 also includes a base portion 41, a connection portion 42, a rear terminal 43, and a front terminal 44. Among the above, the rear terminal 43 and the front terminal 44 are different from the terminal 20 of the first exemplary embodiment.

Similar to the first exemplary embodiment, the front terminal 44 includes a front contact portion 44*a* including a front contact 44*a*1 and a distal end portion 44*a*2, and front spring portions 44*b* that support the front contact portion 44*a* so as to allow the front contact portion 44*a* to be elastically displaced.

Each front spring portion 44*b* is formed with long spring piece portions 44*b*1 and short spring piece portions 44*b*2, and the long spring piece portions 44*b*1 are further configured as a multistage spring. Specifically, each front spring portion 44*b* includes a first bent portion 44*b*3 that bends towards a direction approaching the mating terminal 60 from the base portion 41 side, a first inclined spring piece portion 44*b*4, a second bent portion 44*b*5 that is further bent towards the direction approaching the mating terminal 60, and a second inclined spring piece portion 44*b*6.

When the long spring piece portion 44*b*1 is configured as a multistage spring including not only the first bent portions 44*b*3 but also the second bent portion 44*b*5, the total length of the metal material used as a spring can be longer than the length of the linear spring piece portion 24*b*1 of the first exemplary embodiment when the terminal material is press punched. Then, since the space h becomes longer in the longitudinal direction of the terminal 40, in a similar manner, the total length of the metal material that is to be the rear terminal 43 can be longer. Accordingly, even if the total length of the front terminal 44 as a terminal is the same as that of the front terminal 24, the length of the spring can be made longer and can be made to elastically deform in a flexible manner; accordingly, the durability and the contact force as a spring can be further improved with respect to the first exemplary embodiment. In particular, as is the case of a floating connector, the third exemplary embodiment is suitable for applications that may receive vibration and impact while in a fitted state.

Furthermore, not only the first bent portions 44*b*3, but also the second bent portion 44*b*5 is formed in the front spring portion 44*b*. With the above, an angle of inclination of the second inclined spring piece portion 44*b*6 (an angle of bend of the second bent portion 44*b*5) with respect to the contact surface of the mating terminal 60 of the mating connector 51 or the front surface of the base portion 41 (or a plane parallel to the front surface of the base portion 41) becomes large and even if the total length of the terminal 40 is not increased, a predetermined spring length can be obtained in the front spring portion 44*b*; accordingly, as illustrated in FIG. 17A, the contact area of the front contact 44*a*1 can be made wider than the contact area of the front contact 24*a*1 of the first exemplary embodiment illustrated in FIG. 17B. In a similar manner with the above, since in the rear terminal 43, the angle of inclination of a rear spring portion 43*b* is larger than that of the first exemplary embodiment, even if a rear contact 43*a* is not bent in multistages, the contact area is wider than that of the first exemplary embodiment.

Accordingly, in a state in which the connectors are fitted together, due to the assembled state of the terminals, if the mating terminal 60 passes through the base end of the front contact portion 24*a* and is in contact with the short spring piece portion 24*b*2 of the front spring portion 24*b*, the contact width becomes large and the contact pressure is decreased, and, accordingly, contact reliability cannot obtained. However, in the present exemplary embodiment, since the front contact 44*a*1 can obtain a large contact area, the above failure can be averted from occurring. Furthermore, in the first exemplary embodiment, the contact area of the front contact 24*a*1 that comes in line contact with the mating terminal 60 with its curved shape is small and when the mating terminal 60 comes into contact with the short spring piece portion 24*b*2, because the surface of the short spring piece portion 24*b*2 has a planar shape, the form of contact becomes a surface contact and the contact pressure decreases. However, in the present exemplary embodiment, since the contact area of the front contact 44*a*1 that comes in line contact with its curved shape is large, even if, due to the assembled state and the like, the contact portion is out of position, the contact pressure does not decrease such that conductive connection with high contact reliability can be achieved.

Furthermore, as illustrated in FIG. 17A, in the present exemplary embodiment, the second inclined spring piece portion 44*b*6, the front contact 44*a*1 having a bent shape, and the distal end portion 44*a*2 are supported by the second bent portion 44*b*5 that has an angle of inclination (an angle of bend) with respect to the contact surface of the mating terminal 60 when the mating connector 51 is inserted or the front surface of the base portion 41 (or the parallel surface of the front surface of the base portion 41) that is sharper than the angle of inclination of the first bent portions 44*b*3 and that does not easily become elastically deformed. Accordingly, when in contact with the mating terminal 60, since the elastic displacement having the sharp angled second bent portion 44*b*5 as its pivoting fulcrum can be made smaller, compared to the first exemplary embodiment illustrated in FIG. 17B, the positional displacement between the contact position CP1 before coming in contact with the plug terminal 60 and the contact position CP2 after contact can be made small in the longitudinal direction of the terminal 40.

In other words, as is the case of the first exemplary embodiment in which the bent portion 24*b*3 of the front terminal 24 is the only fulcrum of displacement of the front contact 24*a*1, the contact position CP2 in contact with the plug terminal 60 is disadvantageously moved towards the short spring piece portion 24*b*2 side as the front spring portion 24*b* is displaced as if falling down, and when the plug terminal 60 becomes out of position from the original contact area of the front contact portion 24*a* and comes into contact with the short spring piece portion 24*b*2, the contact pressure may be reduced disadvantageously. Conversely, in the case of the front spring portion 44*b* of the present exemplary embodiment, as described above, the positional displacement between the contact positions CP1 and CP2 before and after coming in contact with the mating terminal 60 can be made small; accordingly, the contact can be in contact in a stable manner without the above disadvantage.

In the front terminal 44, the front spring portion 44*b* of the front terminal 44 is configured as a two-stage spring and since the overall length of the metal material used as the spring becomes long, the front terminal 44 is capable of being elastically deformed in a flexible manner; accordingly, the durability and the contact force as a spring can be further improved from those of the first exemplary embodiment. In particular, as is the case of a floating connector, the third exemplary embodiment is suitable for applications that may receive vibration and impact while in a fitted state.

Figure 16A:
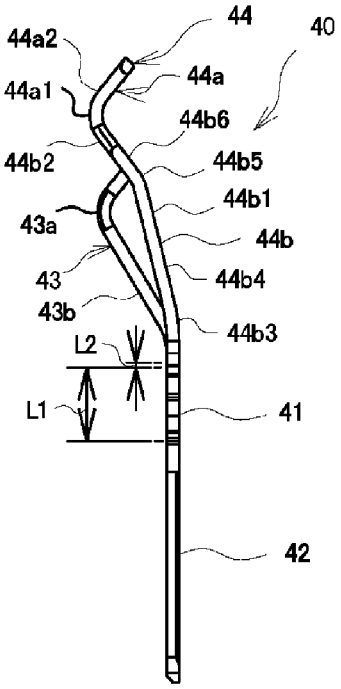
Figure 16D:
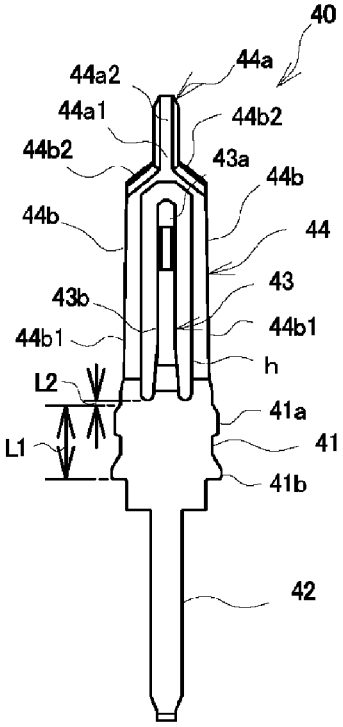
Figure 16D:
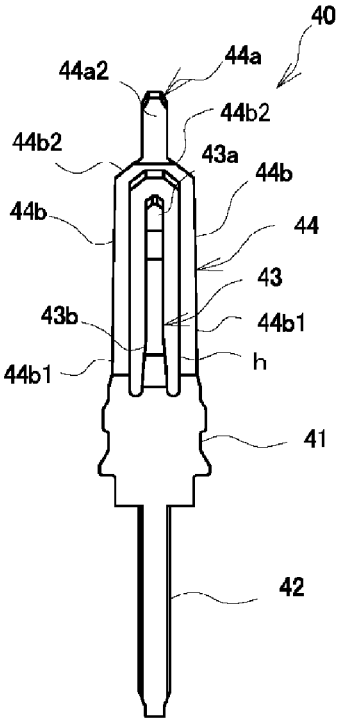
Figure 16D:
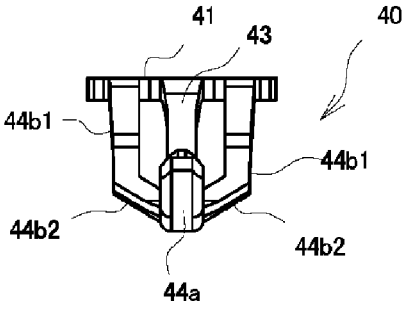
Figure 16E:
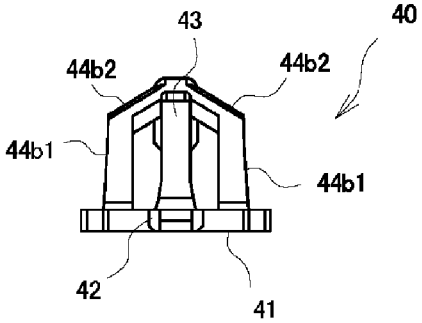

As illustrated in FIGS. 16A and 16B, the front spring portions 44*b* of the front terminal 44 and the rear spring portion 43*b* of the rear terminal 43 described above are formed so as to extend from the boundary portion of the restriction portion L1 in the plate edge portions 41*a* of the base portion 41 to which the retaining portion 12*e* of the housing 12 is fixed.

In the base portion 21 of the first exemplary embodiment, the non-restriction portion L2 is present on the upper side of the restriction portion L1. In such a case, the base ends of each of the rear terminal 23 and the front terminal 24 are integrated at the non-restriction portion L2; however, since the non-restriction portion L2 protrudes into a fitting chamber of the housing 12 as a single and hard spring piece, the whole length of the terminal portion that protrudes into the fitting chamber of the housing 12 cannot be effectively utilized as a spring with high flexibility. Accordingly, in the present exemplary embodiment, the non-restriction portion L2 is reduced to a practically negligible amount and the base ends of the front terminal 44 and the rear terminal 43 are formed so as to extend from the boundary portion of the restriction portion L1 in the base portion 41 such that a structure in which three terminals (two front terminals and one rear terminal) directly protrude into the fitting chamber of the housing 12 is provided. Accordingly, since there is no wasted portion in the terminal portion that can be effectively used as a spring, contribution to reduction in size of the connector can be made.

Other Exemplary Embodiments

The exemplary embodiments described above are merely exemplary embodiments of the present disclosure. The present disclosure is not limited to the above described exemplary embodiments and appropriate changes can be made within the scope of the present disclosure. For example, the plate width of the front contact portion 24*a* of the terminal 20 of the first exemplary embodiment may be configured to be narrower than front spring portion 24*b* such that the front terminal 24 is formed as a tapered spring from the base end to the distal end.

Furthermore, rather than providing the terminals 20 and the terminals 30 in the socket connector 11, they may be provided in the plug connector 51. In other words, terminals having the characteristics of the rear terminals 23 and 33 and the front terminals 24 and 34 may be provided in the plug connector 51. However, changes such as increasing the length of the connection portions 22 and 32, providing the retaining portion that retains the base portions 21 and 31 in the fitting projection 57, and providing a belt-shape terminal in the socket connector 11 need to be appropriately performed.

What is claimed is:

1. A connector, comprising:

a housing; and a plurality of terminals that are retained in the housing and that are spaced apart from each other in a width direction, the connector being electrically connected by being in contact with mating terminals of a mating connector, wherein the terminals include a base portion retained in the housing, and a front terminal and a rear terminal that extend in parallel from the base portion, the front terminal includes a front contact portion that comes into contact with a mating terminal through a flat plate surface of the front terminal, and a front spring portion that extends from the base portion to the front contact portion, the rear terminal includes a rear contact portion that comes into contact with a mating terminal through a flat plate surface of the rear terminal and a rear spring portion that extends from the base portion to the rear contact portion, the front contact portion and the rear contact portion are arranged at a same position in the width direction and facing in a same direction, when fitted to the mating connector, the front terminal performs wiping of foreign substances adhered to the mating terminal, and the rear terminal following the front terminal comes into contact with the mating terminal at a surface where the front terminal performs wiping of foreign substances, and the front spring portion of the front terminal includes a plurality of bent portions that are sequentially bent from the base portion to the front contact portion in directions that approach the mating terminal.

2. The connector according to claim 1, wherein the front spring portion of the front terminal and the rear spring portion of the rear terminal extend from a boundary portion of a restriction portion, the restriction portion being a portion in the base portion restricted by the housing.

3. The connector according to claim 1, wherein at least either one of the front spring portion and the rear spring portion is a tapered spring in which a distal end side is narrower than a proximal end side.

4. The connector according to claim 1, wherein the front spring portion of the front terminal extends from two portions of the base portion and is linked at a portion before the front contact portion so that a space in which the rear terminal is disposed so as to be interposed in the middle is formed.

5. The connector according to claim 1, wherein when the connector is fitted to the mating connector, the front terminal performs wiping of a foreign substance adhered to the mating terminal and the rear terminal following the front terminal comes into contact with the mating terminal.

6. The connector according to claim 1, wherein a contact pressure of the front terminal is set smaller than a contact pressure of the rear terminal.

7. The connector according to claim 1, wherein the front contact portion protrudes more towards the mating terminal side with respect to the rear contact portion.

8. The connector according to claim 1, wherein a width of the front contact portion is equivalent to a width of the rear contact portion.

9. The connector according to claim 1, wherein a width of the front contact portion is larger than a width of the rear contact portion.

* * * * *